United States Patent [19]

Bohn

[11] 3,939,927

[45] Feb. 24, 1976

[54] COMBINED GRAVEL PACKING AND PERFORATING METHOD AND APPARATUS FOR USE IN WELL BORES

[75] Inventor: Floyd O. Bohn, Houston, Tex.

[73] Assignee: Dresser Industries, Inc., Dallas, Tex.

[22] Filed: Nov. 4, 1974

[21] Appl. No.: 520,585

[52] U.S. Cl. ..... 175/4.52; 175/4.59; 166/297

[51] Int. Cl.[2] ..... E21B 43/11

[58] Field of Search..... 175/4.52, 4.59, 4.6; 166/278, 297, 55.1, 51

[56] References Cited

UNITED STATES PATENTS

| | | | |
|---|---|---|---|
| 3,011,551 | 12/1961 | Young et al. | 175/4.52 |
| 3,064,733 | 11/1962 | Bourne | 175/4.52 |
| 3,115,932 | 12/1963 | Reynolds | 175/4.52 |
| 3,138,206 | 6/1964 | Bruce et al. | 175/4.52 |
| 3,433,302 | 3/1969 | Shore | 175/4.52 X |
| 3,463,248 | 8/1969 | Bell | 175/4.52 |
| 3,507,340 | 4/1970 | Voetter | 175/4.52 |
| 3,593,797 | 7/1971 | Lebourg | 175/4.52 X |
| 3,612,189 | 10/1971 | Books et al. | 175/4.59 X |
| 3,856,094 | 12/1974 | Davis | 175/4.52 |

*Primary Examiner*—David H. Brown
*Attorney, Agent, or Firm*—William E. Johnson, Jr.

[57] ABSTRACT

A well tool apparatus having a perforating section at its lower end has an upper section comprised of a reservoir containing a compatible perforating fluid and a pump for pumping such fluid down through the perforating section and out the lower end of the apparatus. A protective shield containing a sand control medium is provided for causing the perforating fluid to displace the well bore fluid in the region along the length of the perforating section, such displaced fluid being recaptured above a floating piston in the reservoir containing the perforating fluid. Means are provided for releasing the compatible perforating fluid into the annulus between the shield and the perforating section, the lower end of the shield having a gravel screen and a port for releasing the perforating fluid into the annulus between the apparatus and the casing to be perforated. Upon perforating, the sand control medium settles into place inside the shield to provide sand control for the formation being produced.

4 Claims, 2 Drawing Figures

COMBINED GRAVEL PACKING AND PERFORATING METHOD AND APPARATUS FOR USE IN WELL BORES

RELATED APPLICATIONS

This application is an improvement upon U.S. patent application Ser. No. 411,982, filed Nov. 1, 1973, now U.S. Pat. No. 3,856,094, which is assigned to the assignee of this application.

BACKGROUND OF THE INVENTION

The present invention relates generally to method and apparatus for producing clean perforations in wells and particularly to method and apparatus which provide sand control while displacing well fluids within a cased borehole in the area to be perforated with fluids which are compatible with perforations.

When an oil well casing is perforated in the presence of well fluids containing colloids and other particulate matter for pressure control, the perforation in the oil-bearing formation is often sealed with a filter cake. The prior art has recognized that it is desirable to displace the fluids in the area of the perforation with so-called "completion fluids" in order to produce clean perforations. Typical of such prior art is U.S. Pat. No. 3,138,206 to George H. Bruce et al; U.S. Patent No. 2,842,205 to Allen et al; and U.S. Pat. No. 2,963,088 to Corley. For example, in the Bruce et al patent, the completion fluid is pumped from a reservoir into the annulus between the perforating section and the casing to be perforated. This device attempts to cause the displaced well fluid to be pumped down to the open lower end of the perforating section and up through the interior of a packer and out into the annulus above the packer. However, such a device as is shown in the Bruce et al reference is quite complex and expensive to fabricate. Furthermore, in the Bruce et al system, the compatible fluid is introduced into the annulus above the perforator and is thus dependent upon the displaced fluid being pumped down the annulus and then back up through the interior of the perforator. Thus, the interior of the perforator has to be modified to provide a tortuous path around the shaped charges within the gun. It should also be appreciated that the Bruce et al apparatus is dependent upon extremely intricate piping to maintain a separation between the well fluids and the compatible perforating fluid.

The prior art has also used gravel packing processes, for example, U.S. Pat. No. 3,362,475 to J. L. Huitt et al, to provide sand control for producing formations. However, such processes have hereto been run separate from the perforating process, thus requiring two trips into the well.

It is therefore the primary object of the present invention to provide a new and improved method and apparatus for practicing sand control while displacing the well bore fluid in the area of the casing to be perforated with a fluid which is compatible with such perforations;

It is another object of the invention to provide a combined gravel packing and perforating apparatus for use during a single trip into a well bore; and It is yet another object of the invention to provide a new and improved method and apparatus for practicing sand control while displacing well bore fluid with compatible perforating fluid without necessarily modifying the interior of the perforating gun.

These and other objects of the present invention are accomplished, generally, by a method and apparatus which utilizes a shield around a perforating apparatus and which utilizes a sand control medium in the annulus between the shield and the perforating apparatus to provide sand control. Means are also provided to pump a compatible perforating fluid through such sand control medium and out through a lower port in the shield to displace the well bore fluid along the length of the perforating apparatus These and other objects, features and advantages of the present invention will be more readily appreciated from a reading of the following detailed specification and drawing, in which:

Figure 1:
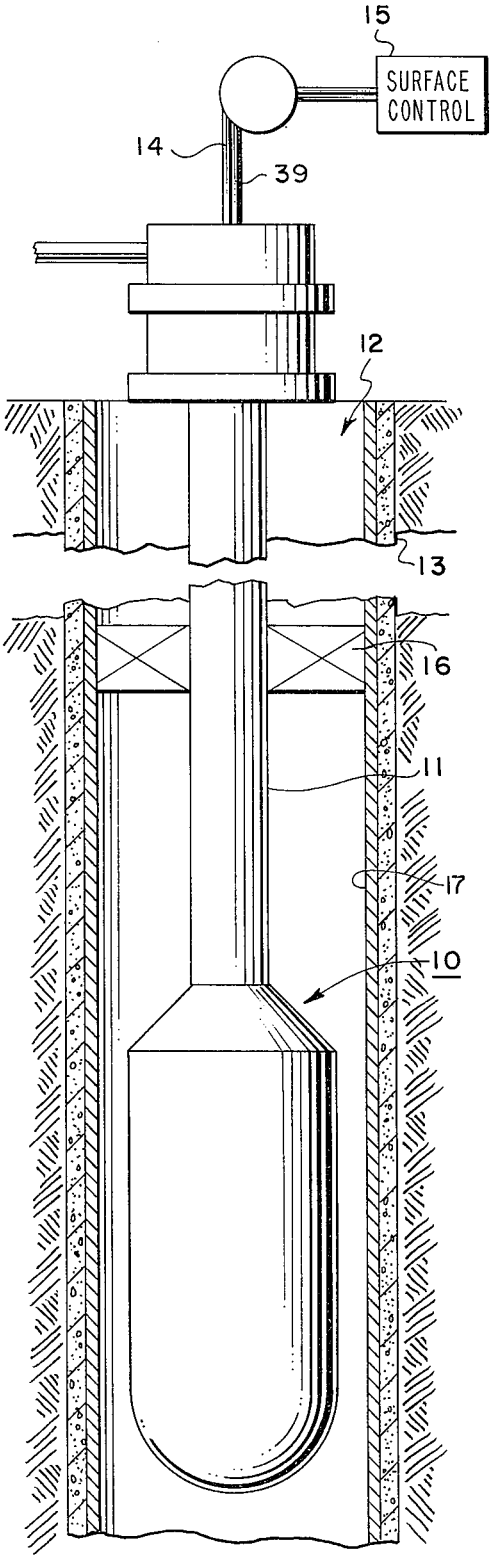
FIG. 1 is an elevated schematic view, partly in cross section, illustrating the earth's subsurface having a borehole and having the apparatus of the present invention suspended therein and also showing the surface control unit which is used in conjunction with the apparatus according to the present invention.

Referring now to the drawing in more detail for a more complete description of the invention, in FIG. 1 is shown a well perforating apparatus 10 suspended on a tubing string 11 in a well bore 12 in which a well pipe string or casing 17 has been run and set in place by a cement sheath. The tubing string 11 contains electrical cables 14 and 39 which extend to the earth's surface in a manner known to those in the art and is connected to the surface control panel 15. Quite obviously, if desired, cables 14 and 39 can be combined in a single cable. The perforator apparatus 10, as is shown in more detail in FIG. 2, contains a plurality of shaped charges or other such well known perforating elements, for example, bullet perforators. A conventional well packer 16 is set in the casing 17 after the apparatus 10 is in a position in the earth borehole opposite the formation to be perforated in a manner well known to those skilled in the art. The packer 16 is used to restrict fluid movement to the area below the packer as will be more readily appreciated from the description given hereinafter.

Figure 2:
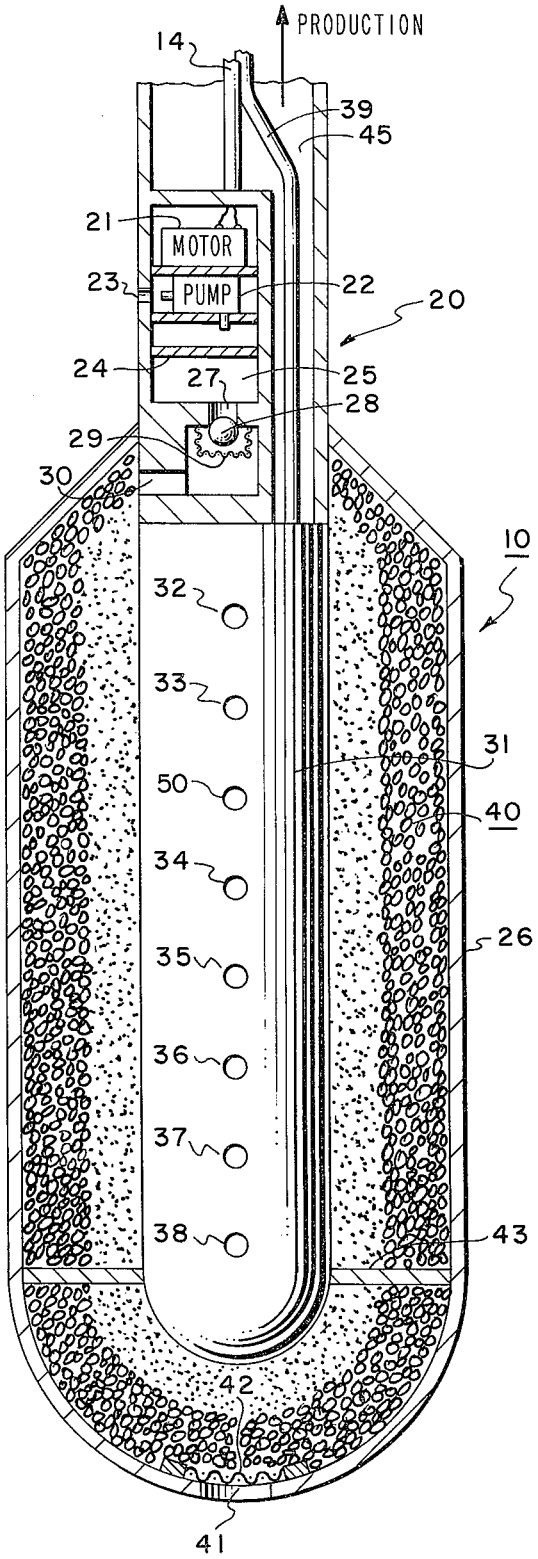
FIG. 2 is an expanded elevated view, partly in cross section, of the apparatus according to the present invention.

Referring now to FIG. 2, there is illustrated in greater detail the apparatus 10 according to the present invention. The top sub 20 of apparatus 10 contains a DC motor 21 coupled to a rotary pump 22 through an appropriate gear box. The rotary pump is pressure balanced by drawing on well fluid through inlet 23 for intake at the hydrostatic head existing at the point of operation. A floating piston 24 contained within the fluid reservoir 25 is arranged such that the rotary pump 22 transfers well fluid to the top side of the floating piston 24. The reservoir 25 is filled with a compatible perforating fluid which may be, for example, water with starch or CMC to reduce filtration, or oil containing a soluble fluid loss additive or some other such completion fluids such as those disclosed in U.S. Pat. No. 2,898,294 entitled "Well Completion Fluids," or in U.S. Pat. No. 2,894,584 entitled "Well Completion," each of such patents being issued to G. G. Priest et al. It should be appreciated that the reservoir 25 is preferably sufficiently large to equal or exceed the volume of the annulus area between the shield 26 hereinafter described and the casing 17 along the length of the perforating section. The reservoir 25 is connected by means of a port 27 having a check valve consisting of the ball 28 and cage 29 and by lower port 30 into the annulus formed between the protective shield 26 and the perforating section 31. Although not illustrated, it should be appreciated that the perforating elements 32–38 and 50 are connected in a conventional manner to the conductive cable 39 which passes along with cable 14 to the earth's surface to enable activation of these elements.

A sand control medium is carried within the annulus formed by the protective shield 26 and the perforating section 31. The lower portion of the shield 26 has a port 41 which allows the compatible perforating fluid to be pumped out through the lower end of the annulus but which has a screen 42 thereover which maintains the sand control medium therein. The sand control medium is preferably comprised of gravel or other such elements well known in the art of "gravel packing" which are sized to be slightly larger than the holes formed within the protective shield by the perforating elements during operation of the apparatus. Smaller gravel, glass beads, sand or other such medium are either interspersed within the larger gravel or placed between the larger gravel and the perforating element 31 to provide a control over the sand in the formations being produced. Spacers 43 help to maintain the concentricity of the shield 26 with respect to the perforator section 31.

In the operation of the apparatus according to FIG. 2, the rotary pump 22 within the upper sub 20 is activated from the earth's surface by voltage applied over the conducting cable 14. The compatible well fluid in the reservoir 25 beneath the floating piston 24 is pumped through the check valve having the ball 28 and out through the port 30 into the annulus formed by the shield 26 and the perforation section 31. The continued pumping action causes the compatible fluid to be forced down through the sand control medium and out the lower port 41 and thus into the annulus between the shield 26 and the casing 17 of FIG. 1 and back up to the portion of the reservoir 25 above the floating piston 24.

It should thus be appreciated that there has been described with respect to the embodiment of FIG. 2 an apparatus which enables compatible perforating fluid to be released at the bottom of the perforating apparatus and which allows compatible perforating fluid to be located between the perforating apparatus and the casing to be perforated without resort to internal piping within the perforating gun and which thus allows conventional perforating guns to be used. As soon as the compatible perforating fluid has displaced the incompatible well bore fluid, the perforating elements are activated by the firing circuit from the earth's surface by means of cable 39 and the perforating section, for example, having a plurality of shaped charges, perforates through the sand control medium 40 and the expendible shield 26 and the casing 17 into the earth's formation. In formations where sand control is necessary, the sand in the formation must be kept out of the oil which is being produced up through the tubing string through the conduit 45 within the tubing string (labeled "production"). The screen 42 over the lower port 41 prevents the sand control medium 40, for example, gravel, from falling out the lower port, and, as previously explained, the sand control medium is preferably gravel which is large enough to not pass out through the perforated holes in the shield 26. The sand control medium also contains gravel or other small particles which keep the sand in the formations from passing into the interior of the perforating section 31 and up through the tubing string with the produced oil.

As the perforator elements pass through the sand control medium, the medium immediately "settles" down into place to provide a barrier to the sand in the production.

Thus, there has been described and illustrated herein the preferred embodiment of the present invention which provides new and improved method and apparatus for simultaneously perforating earth formations and providing a sand control over such formations. It should be appreciated, however, that those skilled in the art will be able to modify this embodiment and that such modifications will fall within the scope of the present invention. For example, if desired, the sand control medium can be sized such that some of the gravel or other medium will pass through the perforated holes in the shield 26 and into the formation in a manner known in the art. Furthermore, the sand control medium can be bonded such that it will not settle down to fill in the perforation holes passing therethrough and by packing off the shield with respect to the casing and thereafter rotating the perforating section, the sand control medium can still be placed between the formation oil and the interior of the perforating unit 31 to thus provide a control over the sand in the produced formations.

Furthermore, if desired, the compatible perforating portion of the apparatus can be eliminated and one can use only that section of the embodiment which causes the perforations and ultimately the produced oil or gas to pass through the sand control medium.

The embodiments of the invention in which an exclusive property or privilege is claimed are defined as follows:

1. An apparatus for perforating casing in an earth borehole, comprising:

an elongated instrument adapted to traverse said borehole;

a perforating section carried by, and being a portion of, said instrument, said perforating section having at least one perforating element therein; and an enclosure having a gravel pack medium therein carried by said instrument and positioned in the line of fire of said at least one perforating element, whereby the activation of said at least one perforating element causes at least a portion of said perforating element to perforate said gravel pack medium prior to perforating said casing.

2. An apparatus attached to a string of oil well tubing for perforating casing in an earth borehole and for producing fluids through said tubing on the same trip, comprising:

an elongated instrument adapted to traverse said borehole;

a perforating section carried by, and being a portion of, said instrument, said perforating section having at least one perforating element therein;

an enclosure having a gravel pack medium therein carried by said instrument; and channel means including said gravel pack medium and the interior of said tubing string and which is in fluid communication with fluids in the borehole following the activation of said at least one perforating element.

3. An apparatus for perforating casing in an earth borehole, comprising:

an elongated instrument adapted to traverse said borehole;

a reservoir within said instrument;

a piston within said reservoir dividing said reservoir into an upper section and a lower section, said upper section having at least one intake port for receiving borehole fluids, and said lower section having at least one outlet port for releasing any fluid in said lower section;

a cylindrical perforating section connected to the lower end of said instrument having a plurality of perforating elements therein;

a cylindrical, expendable shield encircling said perforating section to form an annulus between said shield and said perforating section, said formed annulus containing a sand control medium, said lower section outlet port being in communication with said formed annulus, said shield having at least one outlet port at a location at least to the lower extremity of said perforating elements for releasing fluid from said formed annulus into the annulus between said shield and said casing; and means for activating said piston.

4. The apparatus according to claim 3 wherein said lower section of said reservoir contains a compatible perforating fluid.

* * * * *